US007810706B2

(12) United States Patent
Tsai

(10) Patent No.: US 7,810,706 B2
(45) Date of Patent: Oct. 12, 2010

(54) GRADATIONALLY STACKED CAKE-LIKE ASSEMBLY COMPOSED OF INDIVIDUAL GIFT BOX UNITS

(76) Inventor: Gary Y. Tsai, 5th Floor, No. 136, Li-Teh Street, Chung-ho, Taipei Hsien (TW)

( * ) Notice: Subject to any disclaimer, the term of this patent is extended or adjusted under 35 U.S.C. 154(b) by 274 days.

(21) Appl. No.: 12/150,711

(22) Filed: May 1, 2008

(65) Prior Publication Data

US 2009/0272791 A1 Nov. 5, 2009

(51) Int. Cl.
*B65D 25/00* (2006.01)
*B65D 5/42* (2006.01)
*B65D 5/00* (2006.01)

(52) U.S. Cl. ..... 229/116.1; 229/120.01; 229/115

(58) Field of Classification Search ..... 229/116.1, 229/120.1, 115, 922, 113; 220/376; 206/436
See application file for complete search history.

(56) References Cited

U.S. PATENT DOCUMENTS

| | | | | |
|---|---|---|---|---|
| 1,299,503 | A * | 4/1919 | Pente | 229/115 |
| 6,244,439 | B1 * | 6/2001 | Dennis | 206/457 |
| 7,021,465 | B1 * | 4/2006 | McGuigan | 206/457 |
| 7,607,537 | B2 * | 10/2009 | Katsuyama | 206/525 |
| 2002/0096559 | A1 * | 7/2002 | Quaintance | 229/109 |
| 2005/0087468 | A1 * | 4/2005 | Siethoff et al. | 206/459.1 |

* cited by examiner

*Primary Examiner*—Nathan J Newhouse
*Assistant Examiner*—Christopher Demeree

(57) ABSTRACT

A gradationally stacked cake-like assembly includes a plurality of annular stories overlaid with one another to form a cake-like assembly or tower, wherein each annular story is formed by centripetally fastening a plurality of individual gift box units and each gift box unit may be taken out from each annular story very conveniently.

3 Claims, 3 Drawing Sheets

GRADATIONALLY STACKED CAKE-LIKE ASSEMBLY COMPOSED OF INDIVIDUAL GIFT BOX UNITS

BACKGROUND OF THE INVENTION

U.S. Pat. No. 6,742,674 disclosed a snack dispenser consisting of a series of tiers stacked to resemble a wedding cake. Each tier includes a trough devided into slots. A snack may be placed into each slot. Whenever taking a desired snack from the dispenser, a proper amount of money must be inserted into the dispenser so that someone may withdraw his or her snack through the slot.

The dispenser is so complex to increase production and maintenance cost. It is also very inconvenient to take the snack out from the dispenser because the money must be inserted into the machine.

The present inventor has found the drawbacks of the prior art and invented the present cake-like assembly composed of gift box units for an easier dispensing of the gift box units.

SUMMARY OF THE INVENTION

The object of the present invention is to provide a gradationally stacked cake-like assembly including a plurality of annular stories overlaid with one another to form a cake-like assembly or tower, wherein each annular story is formed by centripetally fastening a plurality of individual gift box units and each gift box unit may be taken out from each annular story very conveniently.

DETAILED DESCRIPTION

Figure 1:
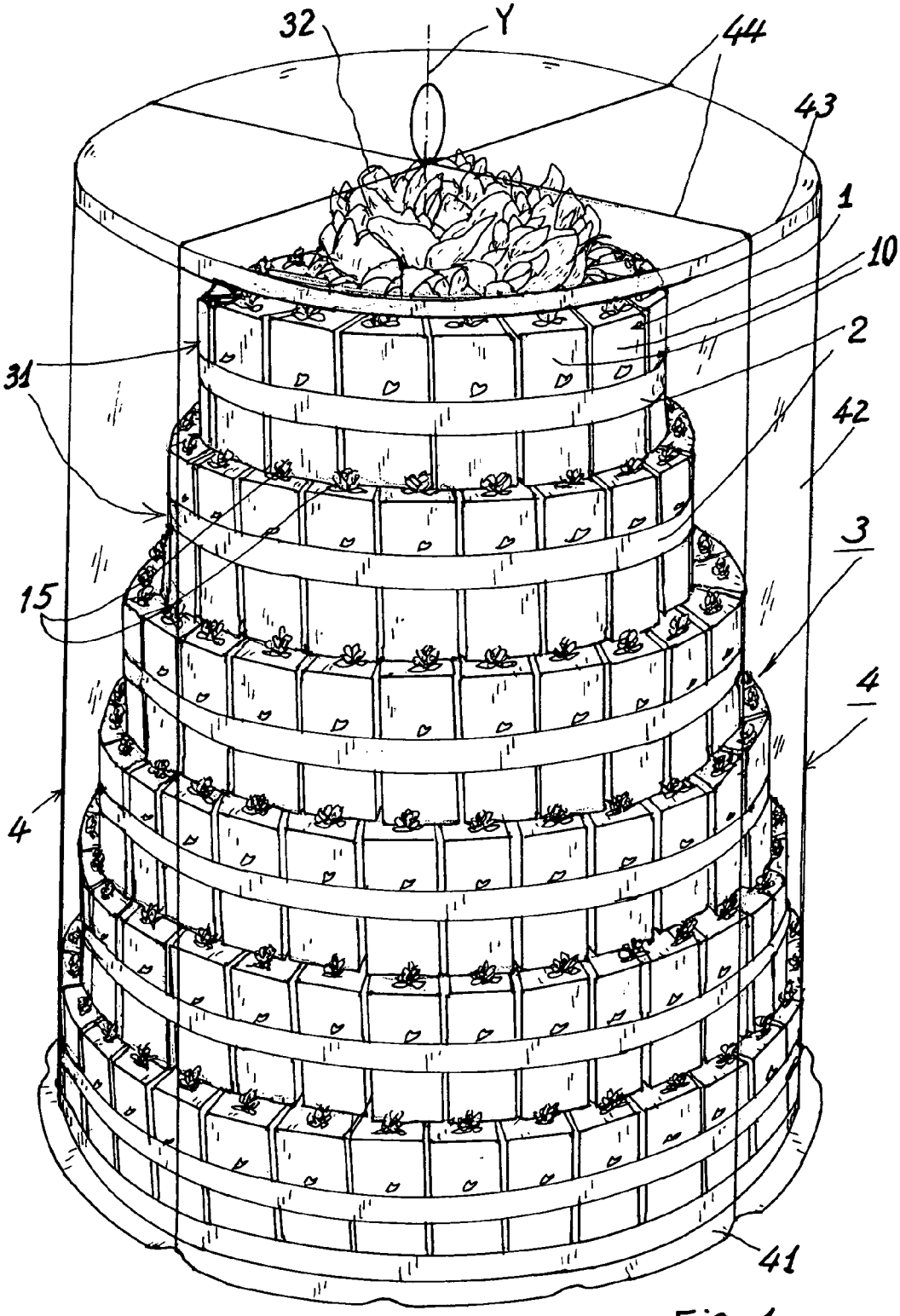
FIG. 1 is an illustration of the present invention.

As shown in the drawing figures, the present invention comprises: a plurality of annular stories 31, each annular story 31 composed of a plurality of individual gift box units 1, which are overlaid with one another to form a cake-like assembly or tower 3.

The annular stories 31 are gradually decreased their diameters from the lowest annular story to the uppermost annular story to thereby form a gradationally stacked cake-like assembly (or tower) 3 as shown in FIG. 1.

Each annular story 31, composed of a plurality of individual gift box units 1, is fastened by a fastening strap 2.

A top decorative article 32 is laid on an uppermost annular story of the annular stories 31 for decoration and for shielding the interior in the assembly 3. An outer case 4, preferably made of transparent materials, is provided to cover the cake-like assembly 3 within the case 4.

Figure 2:
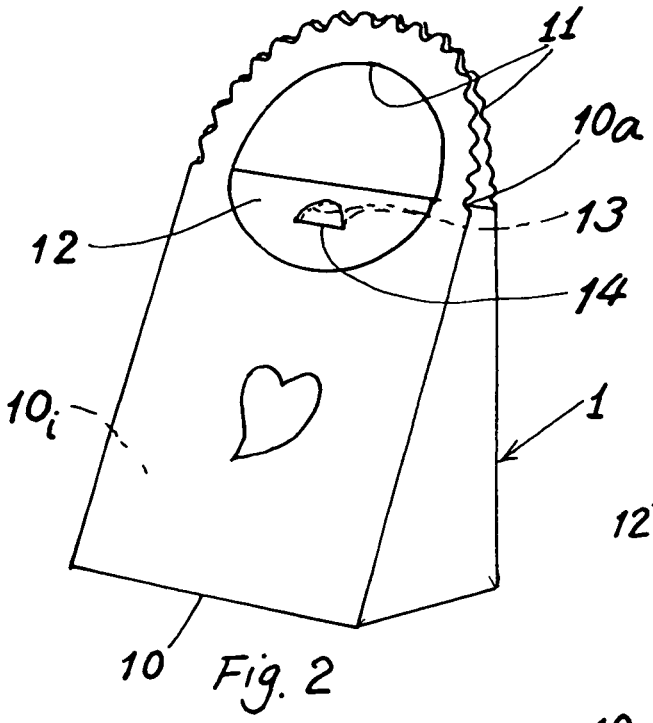
FIG. 2 is a perspective view of an individual gift box unit of the present invention.
Figure 3:
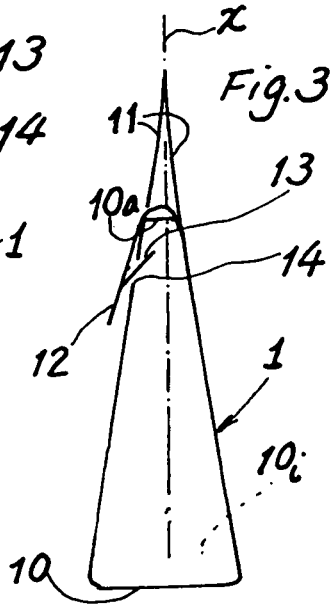
FIG. 3 is a side view of the gift box unit.

Each individual gift box unit 1, especially as shown in FIGS. 2 and 3, includes: a box 10 having a longitudinal sectional view of wedge shape and tapered from a wide bottom portion 10 towards a narrow handle portion 11, a box opening 10*a* formed in an upper portion of the box 10, a box cover 12 hingedly formed on a first portion of the box 10 for covering the opening 10*a* and having a buckle 13 formed on the box cover 12 to be operatively locked with a slot 14 cut in the a second portion of the box 10, and an interior 10*i* defined in the box 10 for filling or storing candy, cake, biscuit, foods, perfume, cosmetics, toys, souvenirs and other small gift items in the interior of box.

Figure 4:
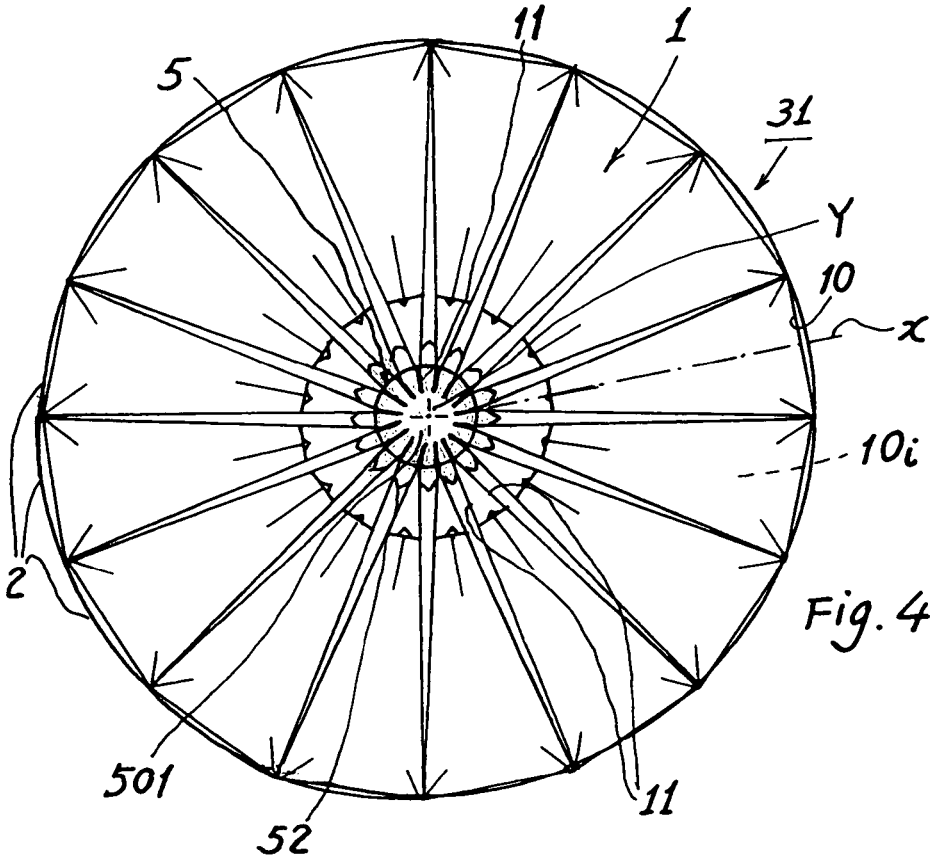
FIG. 4 is a top view of an annular story composed of the gift box units.
Figure 6:
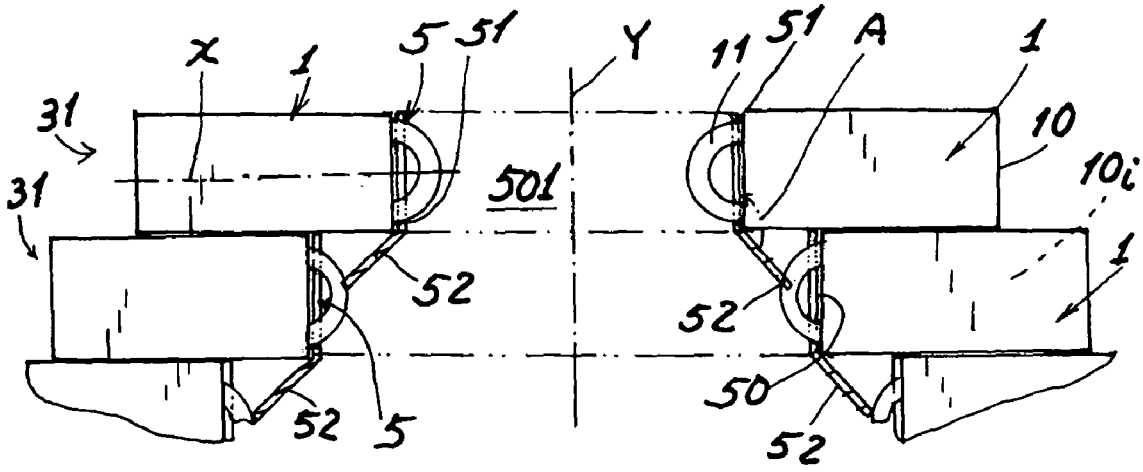
FIG. 6 is a sectional illustration when overlaying the annular stories of gift box units of the present invention.

The plurality of individual gift box units 1 are centripetally assembled about a vertical axis Y of the cake-like assembly 3 to form each annular story 31 of the cake-like assembly 3 by horizontally overlying each individual gift box unit 1 to orient the handle portion 11 of each box unit 10 towards the vertical axis Y and to radially intersect a longitudinal axis X of each individual gift box unit 1 with the vertical axis Y of the cake-like assembly 3 especially as shown FIGS. 4, 6 and 1.

A fastening strap 2 is provided for detachably fastening the plurality of individual gift box units 1 to form each annular story 31 of the cake-like assembly 3.

By overlaying the plurality of annular stories 31 of gift box units 1 with one another to form a gradationally stacked cake-like assembly (or tower) 3 to imitate a wedding cake or birthday cake, the guest may take every gift box unit from the cake-like assembly. The assembly is simple and the withdrawal of each gift box unit 1 from the assembly 3 is also very convenient.

Each annular story 31 of the gift box units 1 may be fastened by a fastening strap 2, as made of decorative ribbon or silk strap, of which two opposite free ends may be detachably tied, or fastened by Velcro tape, not limited in this invention.

Each gift box unit 1 may be further fixed with a small decorative element 15 such as a flower thereon for decorative purpose or for stably limiting an upper annular story 31 on a lower annular story 31.

Figure 5:
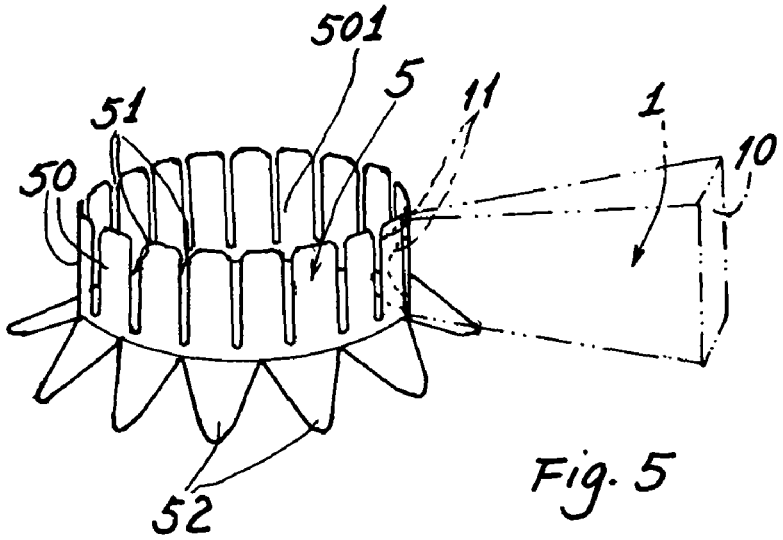
FIG. 5 is an illustration showing the fastening of the individual gift box unit on a retaining ring of the present invention.

As shown in FIGS. 4~6, the plurality of individual gift box units 1 of each annular story 31 are engaged and fastened on a retaining ring 5 for stably forming each annular story 31.

The retaining ring 5 includes: a plurality of slits 51 longitudinally cut in a cylindrical wall 50 having a central hole 501 defined within the cylindrical wall 50 about the vertical axis Y of the cake-like assembly 3; each slit 51 engaged with a handle portion 11 of each individual gift box unit 1; and a plurality of extending tips (or pawls) 52 radially protruding outwardly downwardly from the cylindrical wall 50 to define an obtuse angle A between each extending tip 52 and the cylindrical wall 50 to serve as a "stopper" for limiting an upper annular story 31 on a lower annular story 31 as shown in FIG. 6 for stably overlaying the annular stories 31 for forming the gradationally stacked cake-like assembly 3.

The outer case 4 is preferably made of transparent materials as shown in FIG. 1 and includes: a base 41, a cylindrical (or polygonal) cover 42 secured on the base 41 for disposing the cake-like assembly 3 therein, a top cover 43 formed on a top of the cylindrical (or polygonal) cover 42, and a strip 44 for fastening the covers 43, 42 and the base 41 for carrying the cake-like assembly 3 with the case 4.

The present invention may be further modified without departing from the spirit and scope of the present invention.

I claim:

1. A cake-like assembly comprising:

a plurality of annular stories, each annular story composed of a plurality of individual gift box units, which are overlaid with one another to form a cake-like assembly;

said plurality of annular stories gradually decreasing their diameters from a lowest annular story to an uppermost annular story to form said cake-like assembly as gradationally stacked; and each said individual gift box unit, including: a box having a longitudinal sectional view of wedge shape and tapered from a wide bottom portion towards a narrow handle portion, a box opening formed in an upper portion of the box, a box cover hingedly formed on a first portion of the box for covering the opening and having a buckle formed on the box cover to be operatively locked with a slot cut in a second portion of the box, and an interior defined in the box for filling small gift items therein; and each said gift box unit operatively taken out from said annular story; and said plurality of individual gift box units of each said annular story engaged and fastened on a retaining ring for stably forming, each said annular story of said cake-like assembly.

2. A cake-like assembly according to claim 1, wherein said plurality of individual gift box units are centripetally assembled about a vertical axis of the cake-like assembly to form each said annular story of the cake-like assembly by horizontally overlying each said individual gift box unit to orient the handle portion of each said box unit towards the vertical axis and to radially intersect a longitudinal axis of each said individual gift box unit with the vertical axis of the cake-like assembly.

3. A cake-like assembly according to claim 1, wherein said retaining ring includes: a plurality of slits longitudinally cut in a cylindrical wall having a central hole defined within the cylindrical wall about a vertical axis of the cake-like assembly; each said slit engaged with said handle portion of each said individual gift box unit; and a plurality of extending tips radially protruding outwardly downwardly from the cylindrical wall to define an obtuse angle between each said extending tip and the cylindrical wall to serve as a stopper of an upper annular story to be limited on a lower annular story for stably overlaying the annular stories for forming the cake-like assembly.

* * * * *